US005795180A

United States Patent [19]

Siebens

[11] Patent Number: 5,795,180

[45] Date of Patent: Aug. 18, 1998

[54] ELBOW SEATING INDICATOR

[75] Inventor: Larry N. Siebens, Port Murry, N.J.

[73] Assignee: Amerace Corporation, Hackettstown, N.J.

[21] Appl. No.: 753,980

[22] Filed: Dec. 4, 1996

[51] Int. Cl.[6] ..... H01R 3/00

[52] U.S. Cl. ..... 439/489; 439/921

[58] Field of Search ..... 439/488–491, 439/921, 181–187

[56] References Cited

U.S. PATENT DOCUMENTS 4,210,381 7/1980 Borgstrom ..... 439/921

5,556,287 9/1996 Kuhn et al. ..... 439/489

5,641,306 6/1997 Stepniak ..... 439/491

*Primary Examiner*—Gary F. Paumen

*Attorney, Agent, or Firm*—David Teschner

[57] ABSTRACT

To provide durable elbow seating indicator for high voltage elbow on a high voltage bushing a band of highly contrasting color is formed on or added to an annular recess on the conductive jacket of the bushing. The formation of the bushing insulation within the jacket provides a retaining rib adjacent the band edge and traps the band between the retaining rib and the jacket 15 Claims, 3 Drawing Sheets

ELBOW SEATING INDICATOR

BACKGROUND OF THE INVENTION

1. Field of the Invention

The invention is directed to high voltage mateable components and more particularly to indicators which show the state of assembly of mating high voltage elbows and bushings.

2. Description of Prior Art

An indicator band is placed about a portion of a high voltage bushing. The correct assembly of a high voltage elbow to such a bushing is shown by the obfuscation of the indicator band. An inspector can quickly determine proper assembly of the elbow and bushing visually even if the joint is some distance from the inspector.

At present these bands are printed or painted upon the surface of the conductive jacket of the bushing. The print or paint does not adhere well to the surface of the conductive jacket because of the materials used and due to the silicone grease and cable cleaners often used. Once the paint or print is gone, the older techniques of physically testing the joint with a hot stick must be resorted to.

SUMMARY OF THE INVENTION

The instant invention overcomes the difficulties noted above with respect to the prior art devices by providing an elbow seating assembly indicator which is permanent and is not degraded by continued assembly and disassembly of the bushing and elbow.

A molded conductive jacket is formed with a step or recess at a first end. An elbow seating indicator band, molded or extruded of a contrasting color is placed in the step or recess. The insulating body is now formed in the conductive jacket with portions extending beyond both ends of the conductive jacket. A rib or ridge is formed about the free end of the band in such body formation. The rib engages the band along one face and the other band face engages the wall of the step in the conductive jacket and the band is securely held in the recess. Since the color of the band is in the band itself, multiple assembly or disassembly of the bushing and elbow will not destroy the effectiveness of the band. It is an object of the instant invention to provide a permanent elbow seating indicator.

It is an object of the instant invention to provide an elbow seating indicator which is formed on the associated bushing.

It is yet another object of the instant invention to provide an elbow seating indicator which can be separately formed and assembled to a bushing.

It is still another object of the instant invention to provide an elbow seating indicator formed during the fabrication of a high voltage bushing.

Other objects and features of the invention will be pointed out in the following description and claims and illustrated in the accompanying drawings, which disclose, by way of example, the principles of the invention, and the best mode presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
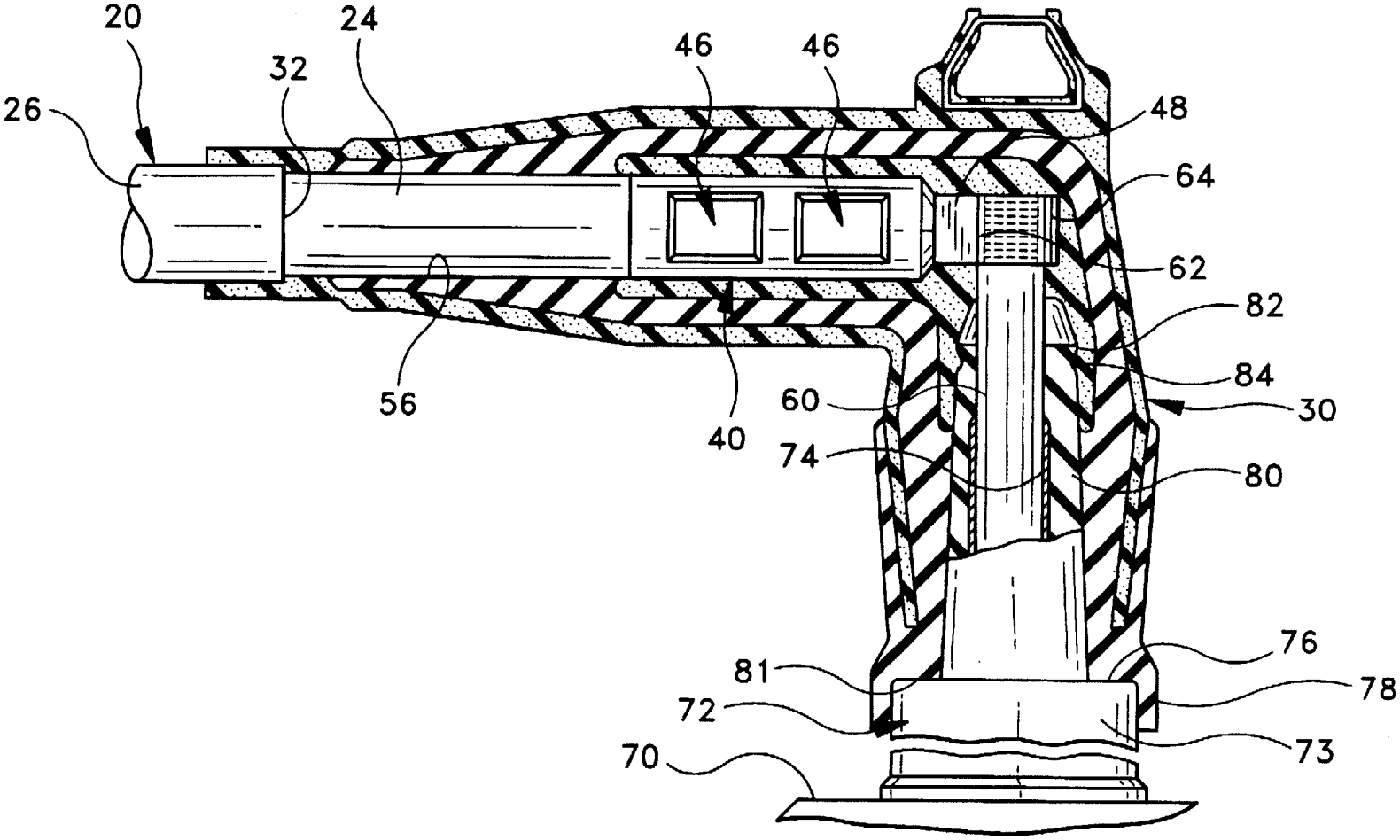
FIG—1 PRIOR ART
FIG. 1 is a fragmentary, side elevational view, partly in section, of a high voltage elbow assembled to a high voltage bushing and is FIG. 2 from U.S. Pat. No. 4,210,381 issued Jul. 1, 1980.

Turning now to FIG. 1 there is shown a high voltage elbow 30 connected at one end to a high voltage cable 20 and coupled to a high voltage bushing 72 at its other end. The high voltage bushing 72 has a main body portion 73 which extends through a panel 70 into a transformer or the like. The extended body portion 80 of bushing 72 terminates in an annular rib 82 and an annular recess 84 which engage an annular recess and annular rib in the cavity of the elbow 30. The step 76 between main body portion 73 and the extended body portion 80 is engaged by surface 81 of elbow 30 and skirt 78 surrounds a portion of the main body portion 73 of bushing 72. When properly seated the annular rib 82 is in a corresponding recess in the bore of elbow 30, the annular recess 84 receives a corresponding annular detent rib in the bore of elbow 30, the end surface 81 of the elbow 30 engages step 76 and the skirt 78 is about a portion of the main body 73 of bushing 72. But there is no simple way to tell from the ground or even close to the joint of the bushing 72 with elbow 30 whether the parts are mated as required. If there is an improper seating there could be internal arcing or a high resistance contact which could cause the components to burn up or at the least provide a poor electrical and mechanical connection. The only way to test the joint is to engage it with a hot stick and push upon the elbow in the seating direction. As a result it was decided to provide a color band on the bushing which would be fully or partially visible if the elbow was not fully seated on the bushing and not visible if the elbow was properly seated upon the bushing. This band of color could be printed or painted upon the bushing but these approaches were not satisfactory.

Figure 2:
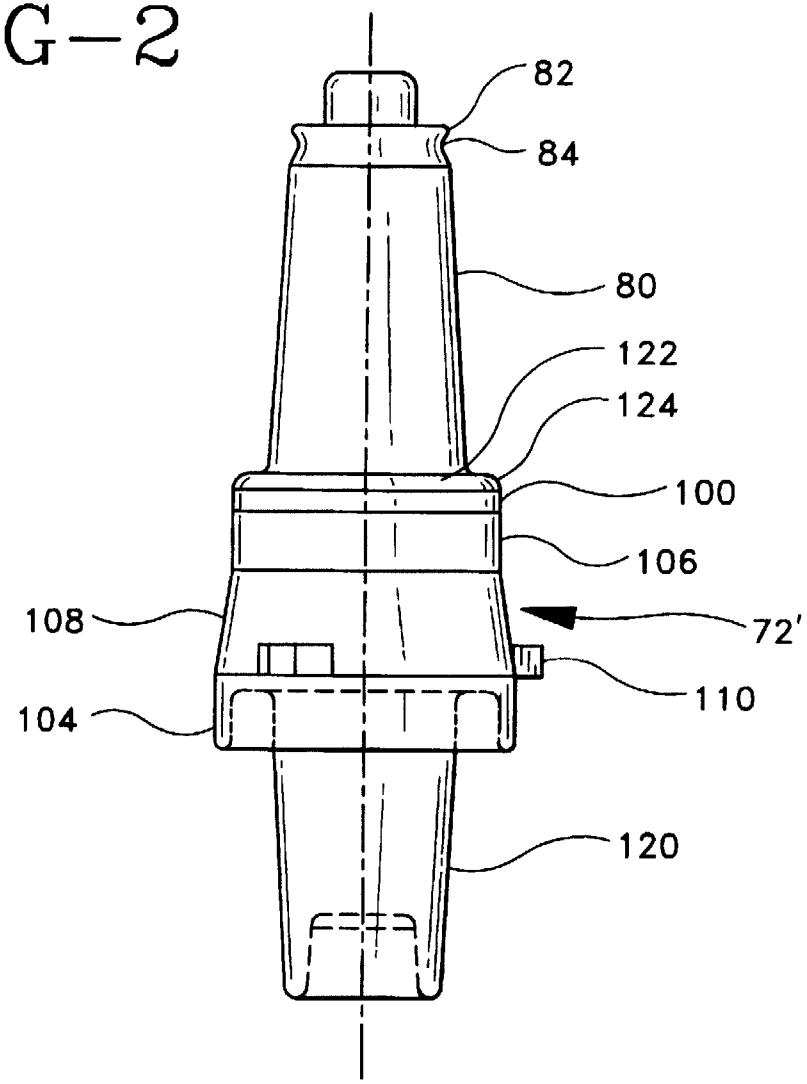
FIG. 2 is a side elevational view of a high voltage bushing having an elbow seating indicator thereon according to the instant invention.
Figure 3:
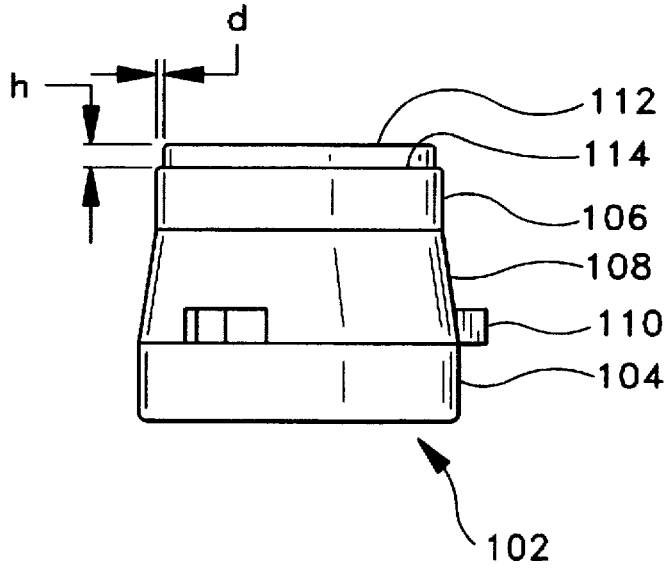
FIG. 3 is a side elevational view of the conductive jacket of the bushing of FIG. 2.
Figure 4:
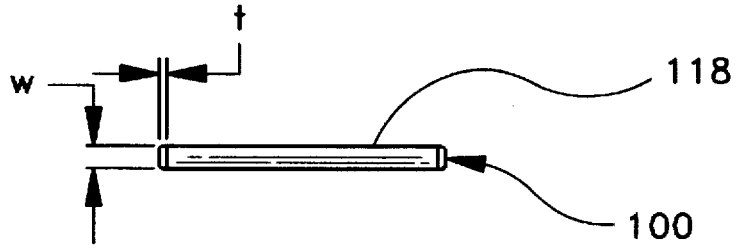
FIG. 4 is a side elevational view of the elbow seating indicator band of FIG. 2.

Turning to FIGS. 2, 3 and 4 there is shown a bushing 72' having an elbow seating indicator band 100 in accordance with the concepts of the invention and the method of manufacturing such an elbow seating band 100.

Bushing 72' has a conductive jacket 102 fabricated from natural or synthetic rubber, plastics or the like and preferably of EPDM elastomeric to which carbon black or the like has been added to make the EPDM elastomeric conductive. Carbon black or equivalent materials may be added to the natural or synthetic rubber or plastics to make them conductive as well. Conductive jacket 102 has a first cylindrical portion 104 and a second cylindrical portion 106 of a lesser diameter. A tapered section 108 joins cylindrical portion 104 to the cylindrical portion 106. A series of stop shoulders 110 at the interface of tapered section 108 with cylindrical portion 104 limit insertion of the bushing 72' into an aperture in a mounting panel (not shown) and make good electrical contact between conductive jacket 102 and the grounded metal mounting panel.

At the free end 112 of cylindrical portion 106 is formed an annular recess or step 114. This annular recess or step 114 is filled by the elbow seating indicator band 100 which has a width "w" equal to the height "h" of the annular recess or step 114. Band 100 has a thickness "t" equal to the depth "d" of annular recess or step 114. By matching the dimensions of band 100 to those of the annular recess or step 114, when the band 100 is in place in the annular recess or step 114 the surface of cylindrical portion 106 will appear continuous. The elbow seating indicator band 100 can be extruded or molded in place in the annular recess or step 114 or separately extruded or molded and then placed in annular recess or step 114. If the band 100 is slightly undersized and since it is made of resilient material it can be stretched for installation and its hoop forces upon relaxation would permit it to securely grip the walls of the annular recess or step 114.

Once the band 100 is in place upon the conductive jacket 102, the insulating body can be extruded or molded within the conductive jacket 102. The insulating body has an interior portion 120 which fits within the transformer enclosure, for example, (not shown) and has a threaded stud which mates with a transformer fitting. Above cylindrical portion 106 is the extended body portion 80 in which are formed annular recess 84 and annular rib 82 which engage corresponding ribs and recesses in the bore of elbow 30.

The bushing 72' includes one other rib, retaining rib 122. This rib 122 engages the free end 112 of conductive jacket 102 and the free edge 118 of band 100. The rib 122 thus traps band 100 between itself and the annular recess or step 114. The leading edge 124 of retaining rib 122 can be rounded to make the movement of skirt 78 of elbow 30 over cylindrical portion 106 of the conductive jacket 102 easier and prevent possible damage to the band 100.

The conductive jacket 102 is generally black because of the presence of carbon black, the insulating body 120, the extended body position 80 and the retaining rib 122 are generally gray and the elbow seating indicator band 100 may be made of white or yellow colored material so that it will stand out against the black colored conductive jacket.

While there have been shown and described and pointed out the fundamental novel features of the invention as applied to the preferred embodiment, it will be understood that various omissions and substitutions and changes of the form and details of the device illustrated and in its operation may be made by those skilled in the art, without departing from the spirit of the invention.

I claim:

1. The method of providing an elbow with a seating indicator comprising the steps of:

a. forming a conductive jacket with a first end and second end and a bore extending therethrough, said conductive jacket having a recess adjacent said first end;

b. placing a band about said conductive jacket and within said recess; and c. forming an insulating body within said conductive jacket, said insulating body having an annular rib adjacent the free end of said band to fix said band in its position about said conductive jacket in said recess.

2. The method of claim 1, wherein said conductive jacket and said band are formed of different colored materials.

3. The method of claim 1, wherein said conductive jacket, said band and said insulating body are formed of different colored materials.

4. The method of claim 1, wherein said conductive jacket is formed of conductive elastomeric material.

5. The method of claim 1, wherein said insulating body is formed of elastomeric material.

6. The method of claim 1, wherein said conductive jacket is formed of conductive elastomeric material and said insulating body is formed of elastomeric material.

7. The method of claim 1, wherein said band is extruded onto said recess in said conductive jacket.

8. The method of claim 1, wherein said band is molded onto said recess in said conductive jacket.

9. The method of claim 1, further comprising the steps of:

a. forming said band independently of said conductive jacket; and b. placing said band in said recess in said conductive jacket.

10. An elbow seating indicator for a high voltage bushing comprising:

a. a hollow jacket formed of conductive material having a first end, a second end and a bore extending therethrough;

b. said jacket having a recess adjacent said first end, said recess having a free end at said first end of said conductive jacket and a step remote from said first end;

c. a band having a first face and second face, said first face adjacent said free end of said jacket and said second face adjacent said step in said conductive jacket;

d. an insulating body extending through said bore and beyond said first and second ends of said conductive jacket; and e. a rib on said insulating body adjacent said free end of said recess and said first face of said band whereby said band is fixed in position in said recess between said rib and said step in said conductive jacket.

11. An elbow seating indicator as set forth in claim 10, wherein said band has a thickness equal to the depth of said recess in said conductive jacket.

12. An elbow seating indicator as set forth in claim 10, wherein said band and said conductive jacket are formed of differently colored materials.

13. An elbow seating indicator as set forth in claim 10, wherein said band, said conducting jacket and said insulating body are formed of differently colored materials.

14. An elbow seating indicator as set forth in claim 10, wherein said band is extruded onto said conductive jacket in said recess.

15. An elbow seating indicator as set forth in claim 10, wherein said band is molded onto said conductive jacket in said recess.

* * * * *